US005937804A

United States Patent [19]

Kaminski

[11] Patent Number: 5,937,804

[45] Date of Patent: Aug. 17, 1999

[54] ENGINE CYLINDER BLOCK AND VALLEY COVER THEREFOR

[75] Inventor: Brian Daniel Kaminski, Lake Orion, Mich.

[73] Assignee: General Motors Corporation, Detroit, Mich.

[21] Appl. No.: 08/916,807

[22] Filed: Aug. 22, 1997

[51] Int. Cl.[6] ..... F02B 75/22

[52] U.S. Cl. ..... 123/54.7; 123/195 C

[58] Field of Search ..... 123/54.7, 54.4, 123/54.6, 195 C

[56] References Cited

U.S. PATENT DOCUMENTS 2,766,743 10/1956 Platner et al. ..... 123/54.7
2,769,434 11/1956 Witzky ..... 123/54.7
2,833,254 5/1958 Carpentier et al. ..... 123/54.7
2,957,460 10/1960 Kolbe ..... 123/54.7

*Primary Examiner*—Marguerite McMahon
*Attorney, Agent, or Firm*—Karl F. Barr, Jr.

[57] ABSTRACT

An engine cylinder block assembly for a V-type engine wherein inner walls of the cylinder banks define a relatively oil free valley which is closed by a rigid valley cover to provide additional stiffness to the inside walls of the blocks, thereby stiffening the block against vibration and bending. The valley cover also includes sealed pockets for enclosing knock sensors mounted upon upwardly extending bosses in the bottom of the valley to both protect the knock sensors and permit their removal without requiring removal of the valley cover from the engine cylinder block. Oil entrainment due to pulsing air flows between crank chambers of the engine are reduced by providing openings in the valley floor between the front and rear crank chambers of the engine while the adjacent inner crank chambers are separated from direct connection with the valley.

11 Claims, 6 Drawing Sheets

ENGINE CYLINDER BLOCK AND VALLEY COVER THEREFOR

TECHNICAL FIELD

This invention relates to internal combustion engines and more particularly to cylinder block assemblies for V-type engines in which a valley is defined between the cylinder banks.

BACKGROUND OF THE INVENTION

It is known in the art pertaining to automotive V-type internal combustion engines to provide an integral cylinder block having a pair of outwardly angled cylinder banks with inside walls defining a valley. In some engines the valley has been closed by an integral cast-in-place wall. In other engines, the valley may be upwardly open and may be closed by the mounting of an engine intake manifold or other member thereon to prevent the escape or contamination of engine oil or oil mist often existing within the valley.

Also, in the past, the cast iron or aluminum intake manifolds of V-type engines generally added to the stiffness of the cylinder block and head assembly by interconnecting the inner walls of the cylinder heads mounted on the cylinder banks. However, with the increasing use of molded plastic intake manifolds, the capability of intake manifolds to provide substantial stiffening of the block assembly is substantially lessened.

SUMMARY OF THE INVENTION

The present invention provides an engine cylinder block assembly that includes an integral cast aluminum cylinder block having an upwardly open valley and a die-cast aluminum valley cover mountable on the block to close the valley and provide stiffening between inside walls of the cylinder block which define the valley. The engine includes push-rod actuated overhead valves with valve actuating mechanisms located between the cylinders and the valley-defining inside walls.

The valley cover is formed as a structurally stiff integral plate-like member having a peripheral lower mounting surface with load carrying peripheral and transverse portions and intermediate portions of the plate made thinner to reduce mass. The cover further includes integral pockets for a receiving knock sensors mounted on bosses extending up from the valley floor, the pockets having seals to protect the knock sensors from internal engine fluids and heat. The mounting allows removal and replacement of the knock sensors without removing the valley cover from the engine.

The cylinder block includes three transverse bulkheads between front and rear end walls to define four longitudinally aligned crank chambers or bulkhead bays. The valley floor has openings connecting with the first and fourth of the crank chambers but not the second and third chambers. Thus cyclic fluid flow between the first and fourth chambers is encouraged to pass through the open valley while out of phase cyclic flow between the second and third chambers travels primarily through the crankcase. Openings in the bulkheads and the end walls help to reduce pressure pulsations within the block and the combination of features substantially reduces oil entrainment in air flowing within the crankcase.

These and other features and advantages of the invention will be more fully understood from the following description of certain exemplary embodiments of the invention taken together with the accompanying drawings.

DESCRIPTION OF THE PREFERRED EMBODIMENT

Figure 1:
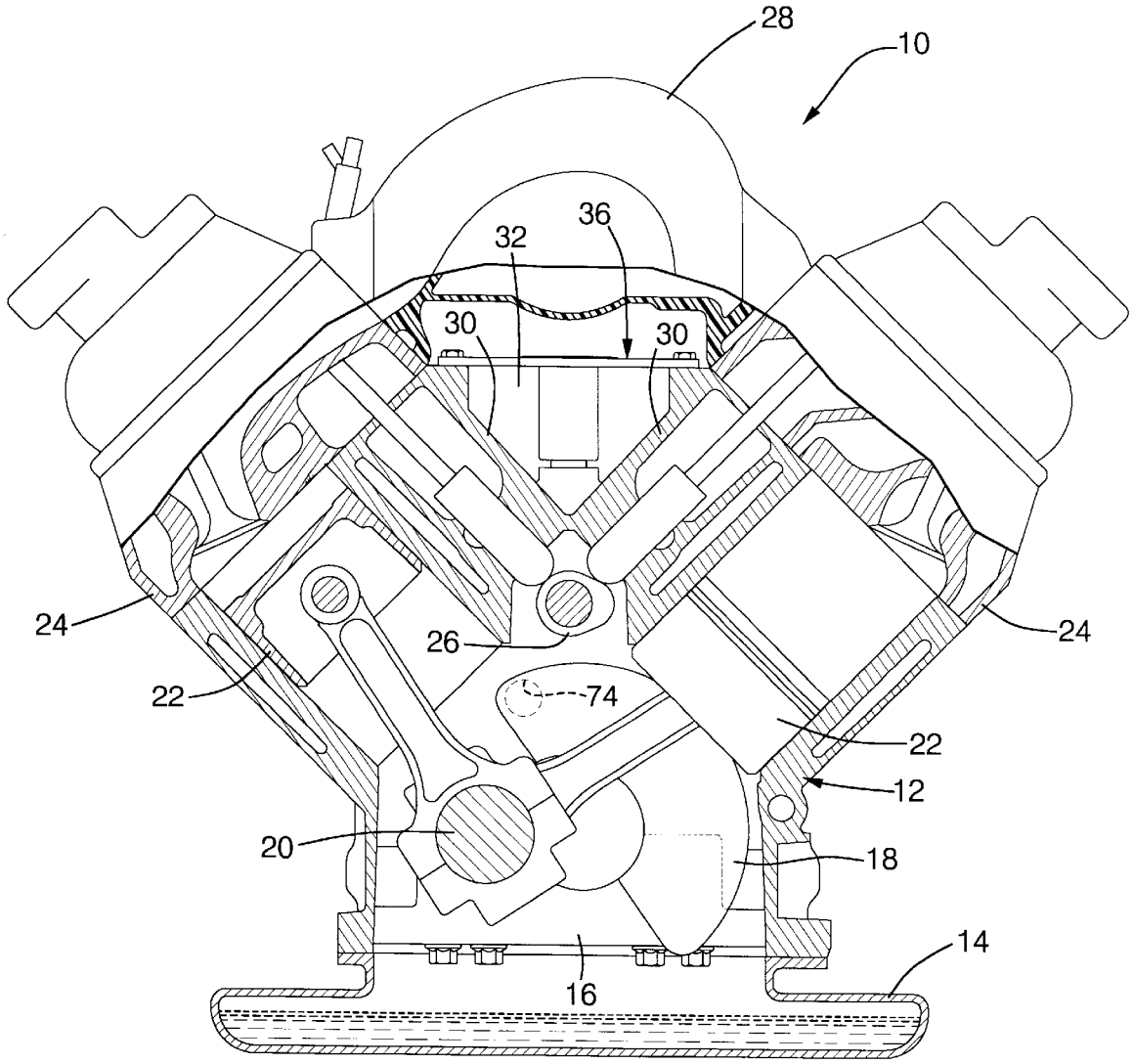
FIG. 1 is a transverse cross sectional view through a high performance V-type automotive engine having a cylinder block assembly formed according to the invention.

Referring first to FIG. 1 of the drawings in detail, numeral 10 generally indicates an automotive V-8 engine for a high performance vehicle having a low ground clearance. Engine 10 includes a cylinder block 12 defining two angularly disposed banks of cylinders connecting downwardly with a crankcase closed at the bottom by a shallow oil pan 14 having a laterally extending sump. Main bearing caps 16, mounted within the crankcase, rotatably support a crankshaft 18 having four individual crankpins 20, each connected with a pair of pistons 22 in oppositely associated cylinders. The cylinder banks are closed by cylinder heads 24 containing valves and valve gear driven by a camshaft 26 rotatably supported in the V of the cylinder block. An intake manifold 28 is mounted on the cylinder heads to provide intake air and fuel to the cylinders.

Figure 2:
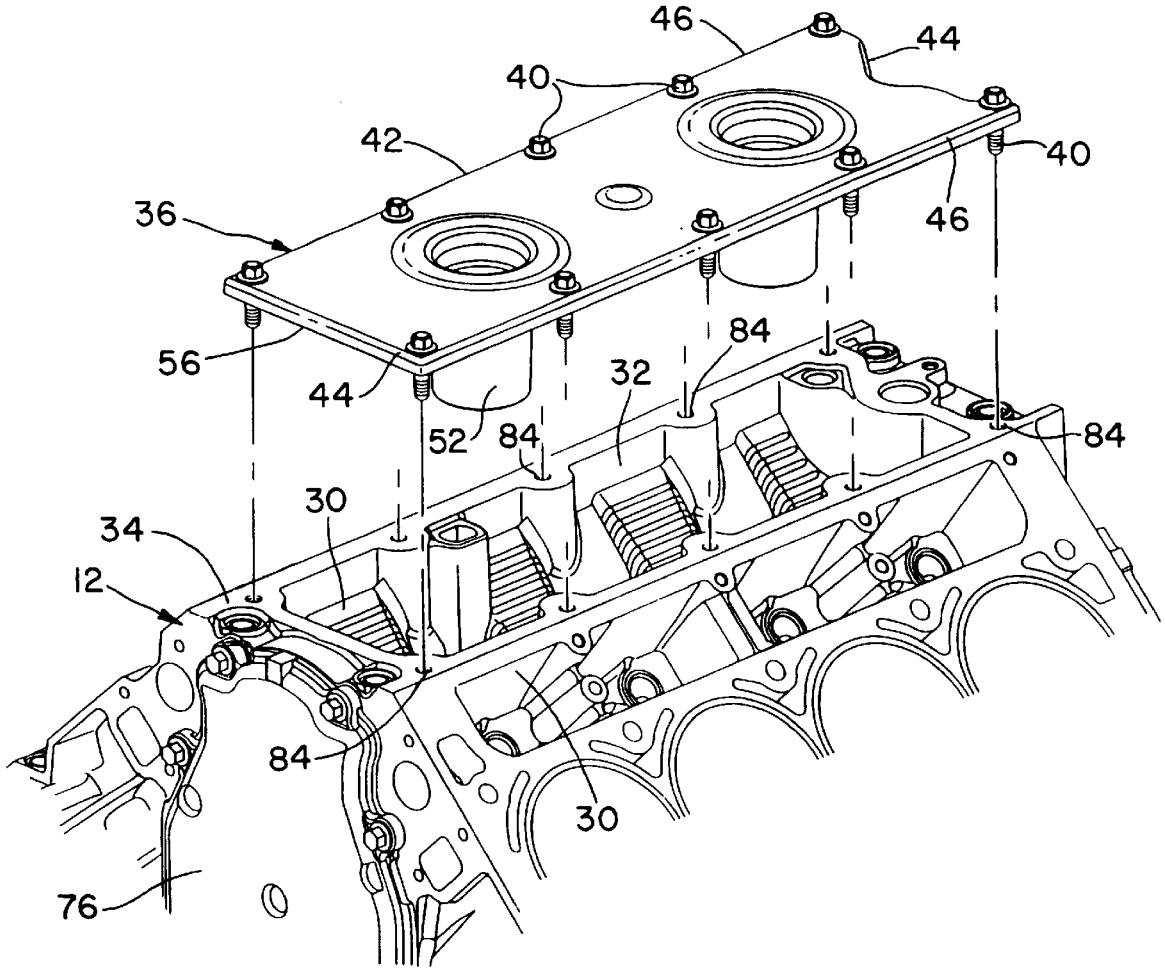
FIG. 2 is an exploded pictorial view of the cylinder block assembly showing the valley cover in position for installation.

Referring to FIGS. 1 and 2, the cylinder banks each include outer and inner walls defining engine coolant jackets. The cylinder block 12 further includes inside walls 30 spaced inward of the cylinder bank walls and separating the valve gear from a valley 32 that is internally defined by the inside walls 30. The valley has an open top defined by upper ends of the inside walls 30 which form a planar mounting surface 34. The valley 32 has its open top closed by a valley cover 36 formed as an integral stiffening plate having a peripheral lower surface 38 which is planar and is secured to the mounting surface 34 of the cylinder block by a plurality of screw fasteners 40.

Figure 3:
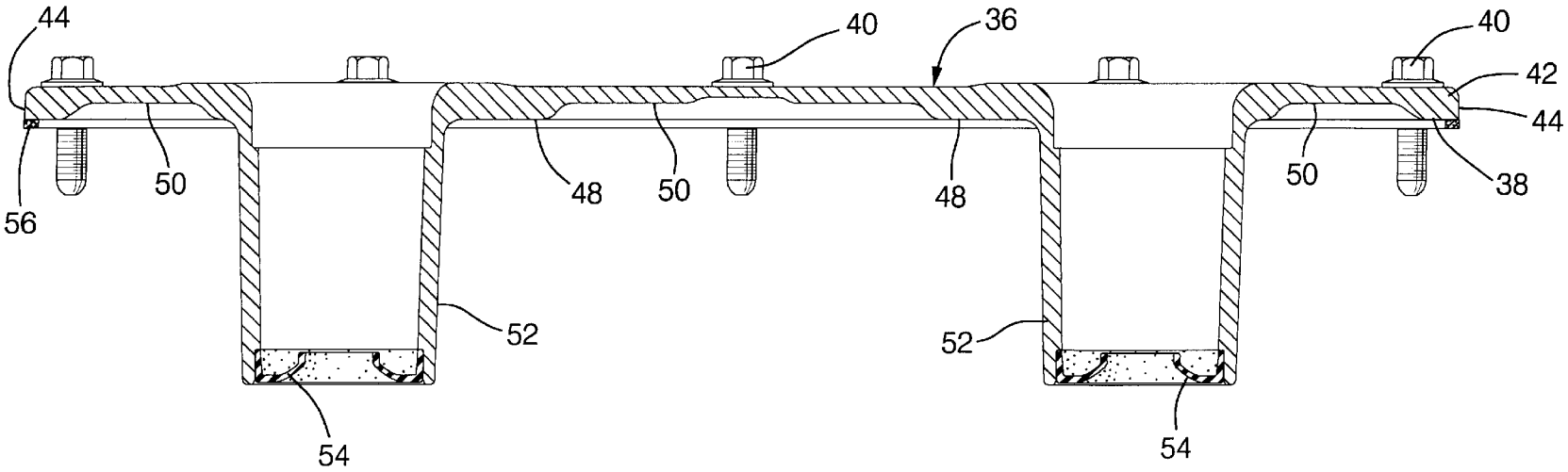
FIG. 3 is a longitudinal cross-sectional view through the valley cover.
Figure 4:
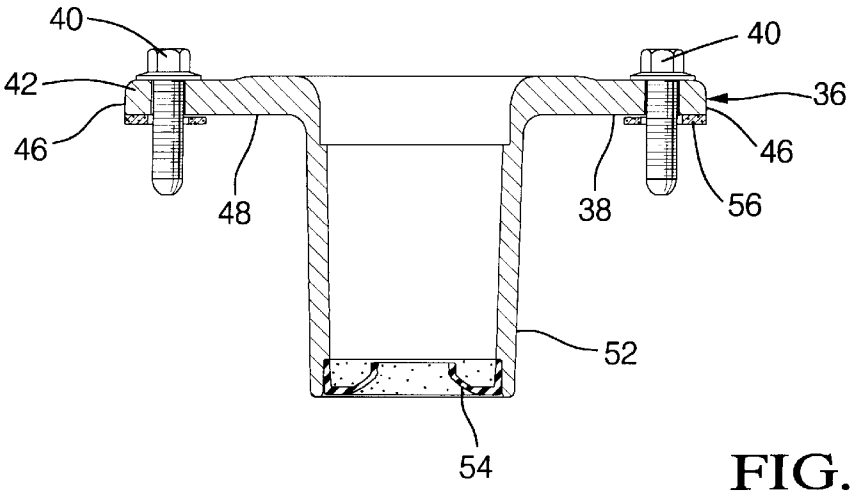
FIG. 4 is a transverse cross-sectional view through the valley cover at one of the fastener locations.
Figure 5:
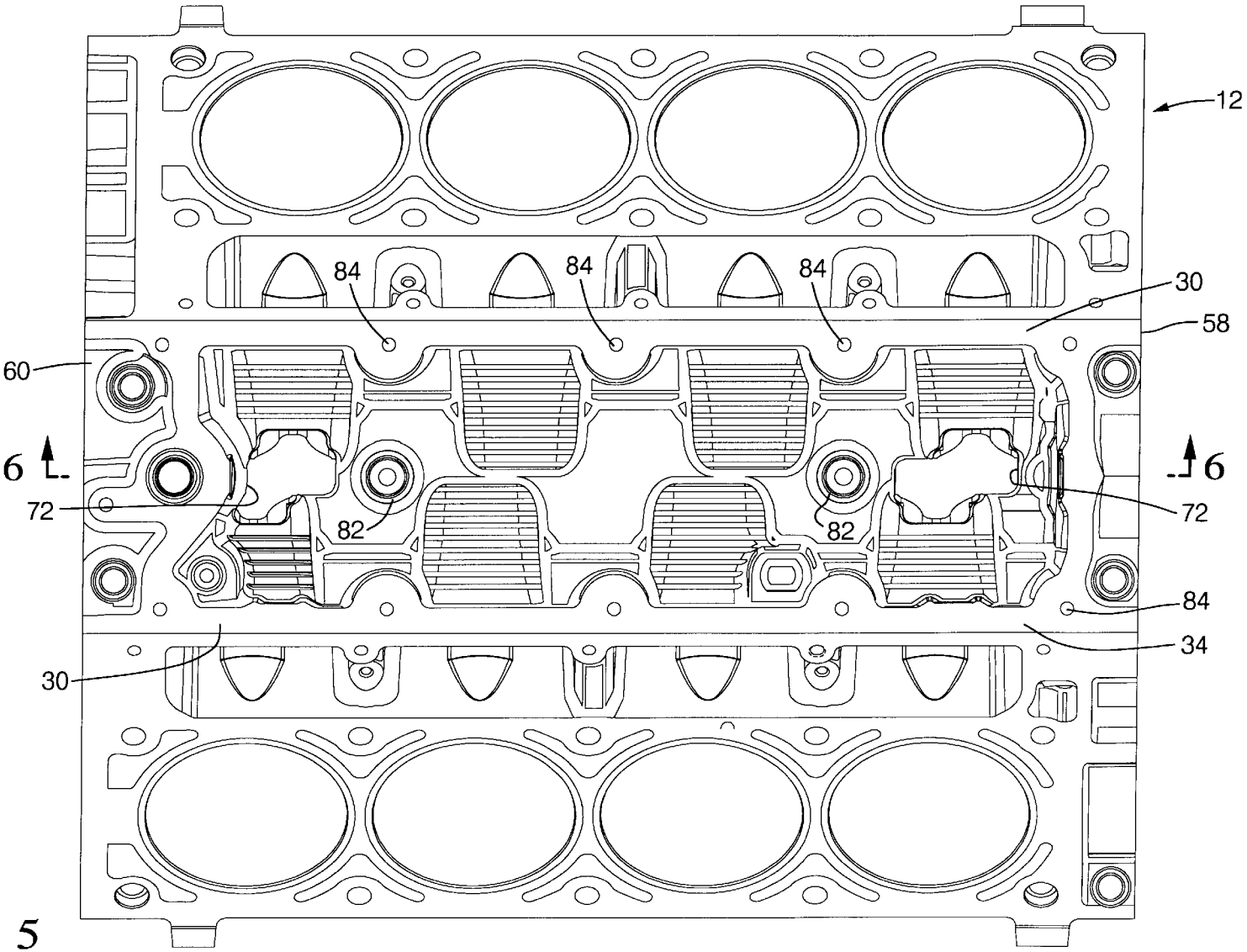
FIG. 5 is a plan view of the engine cylinder block showing the interior of the valley.
Figure 6:
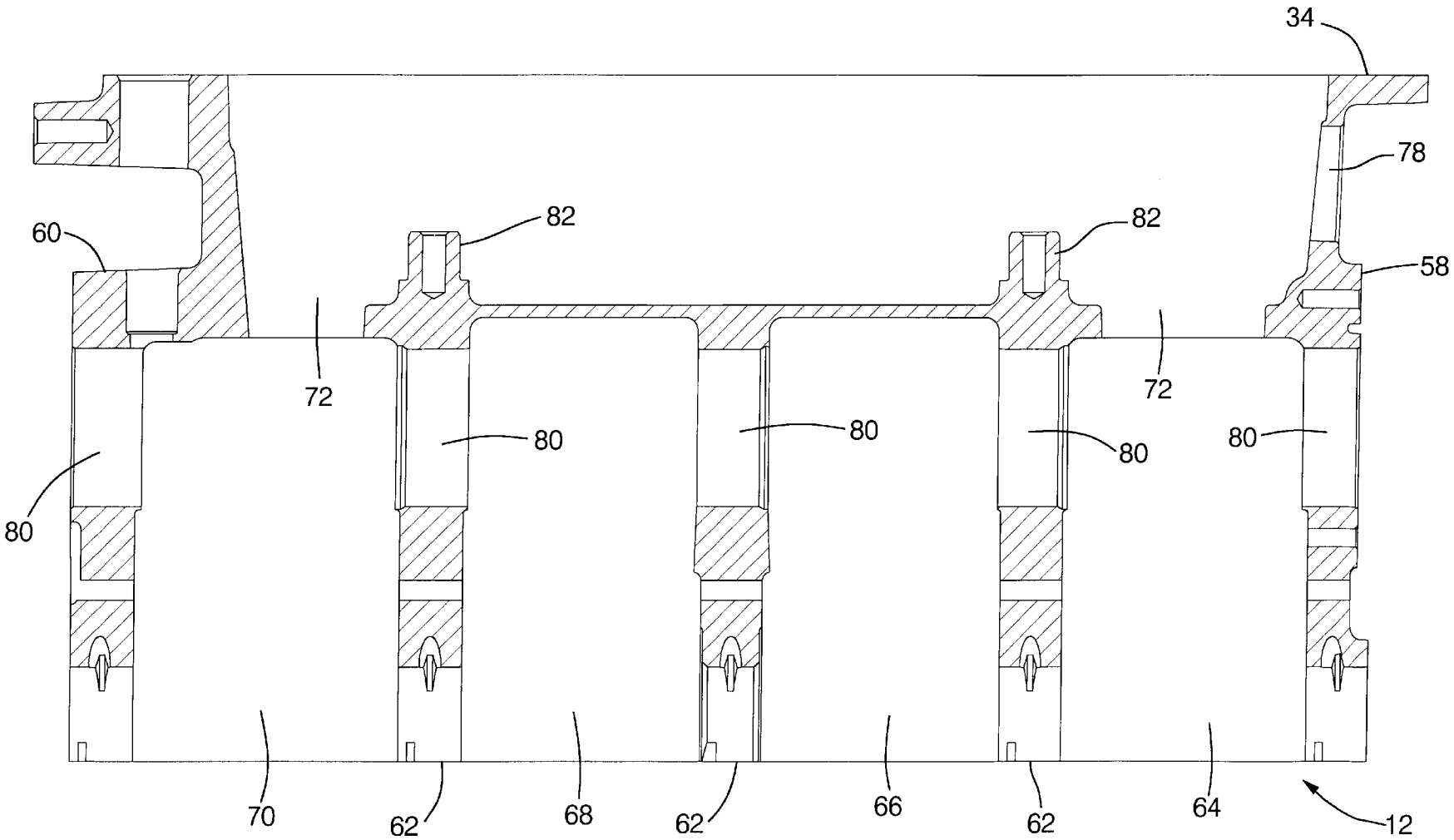
FIG. 6 is a longitudinal cross-sectional view through the cylinder block from the line 6—6 of FIG. 5.
Figure 7:
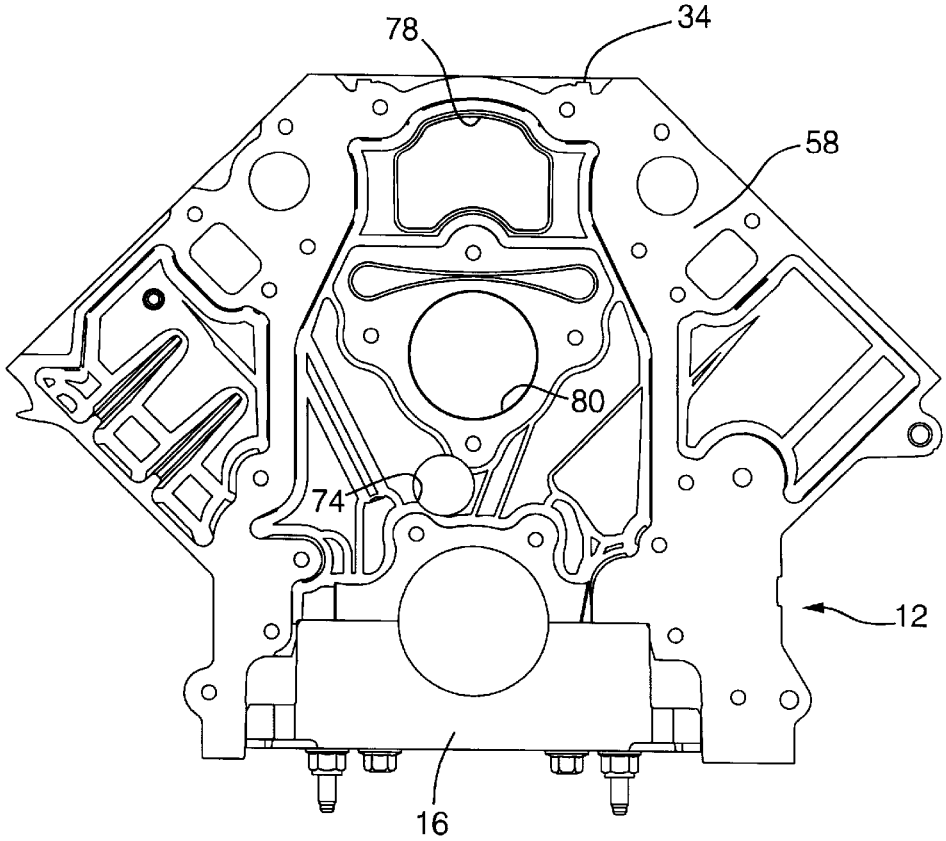
FIG. 7 is a front end view of the cylinder block with main bearing caps installed.
Figure 8:
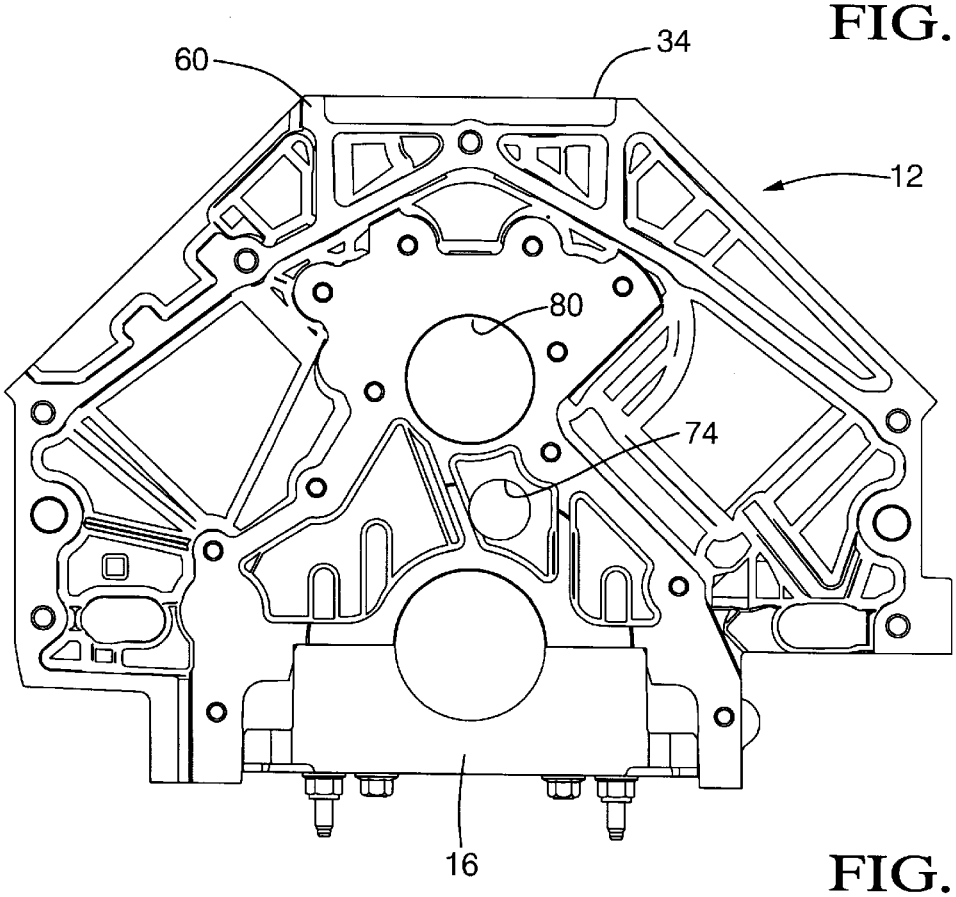
FIG. 8 is a rear end view of the cylinder blocks with main bearing caps installed.

As is best shown in FIGS. 3 and 4, valley cover 36 includes a relatively thick rigid periphery 42 including longitudinally spaced end portions 44 and laterally spaced side portions 46, together defining the lower surface 38. Thickened rigid load carrying transverse portions 48 are spaced longitudinally between the end portions and rigidly interconnect the side portions 46. Reduced thickness panel-like portions 50 extend between the periphery and the load carrying transverse portions and are configured to minimize the mass of the cover while maintaining closure of the valley and adequate stiffness to provide the desired stiffening of the associated cylinder block.

Adjacent to the transverse portions 48, two component receiving pockets 52 are formed by downwardly extending generally tubular walls integral with the cover structure. The cover is formed of aluminum based material to minimize mass. Annular seals 54 are provided at the lower edges of the pockets 52, and extend inward for a purpose to be subsequently described. A hard planar mounting gasket 56 is clamped between the lower surface 38 of the valley cover and the mounting surface 34 of the cylinder block to seal the edges of the valley opening against the escape or admission of fluids from or to the valley.

FIGS. 5–8 of the drawing illustrate pertinent features of the engine cylinder block 12. In addition to the angled inside walls 30 defining the valley, the ends of the valley are defined by a front wall 58 and a rear wall 60 closing the front and rear ends of the cylinder block. Between the front and rear walls, the crankcase portion of the cylinder block is divided by three transverse bulkheads 62 into longitudinally aligned first, second, third, and fourth crank chambers or bulkhead bays 64, 66, 68, 70, respectively. Each of these chambers is open to a transversely opposite pair of cylinders containing pistons connected to a common crankpin of the crankshaft 18.

For reasons to be discussed, openings 72 are provided in the floor of the valley, communicating the valley with the first and fourth crank chambers 64, 70. In contrast, the floor of the valley of the second and third chambers 66, 68 is solid so that these chambers are not communicated directly to the valley. In addition, circular openings 74 are provided in each of the bulkheads and in the front and rear walls of the engine for communication between the chambers and into associated engine covers, the front cover 76 being shown in the assembly of FIG. 2. Further, an additional opening 78 is provided in the front engine wall 58 for directly communicating the valley 32 with the interior of the front cover 76. Additional openings 80, shown in the bulkheads 62 and end walls 58, 60, define bearings for mounting the camshaft and thus do not provide communication for air flow between the chambers.

A pair of cylindrical bosses 82 extend upward from the floor of the valley and include threadable openings on which knock sensors, not shown, are mounted during assembly of the engine. When the valley cover 36 is assembled to the cylinder block, the annular seals 54 in pockets 52 engage the cylindrical sides of the bosses 82 to prevent fluid flow between the valley 32 and the interiors of the pockets 52. The knock sensors, not shown, are subsequently placed within the pockets and secured to the tops of the bosses 82, where they are protected within the pockets and may be removed without removing the valley cover from the engine cylinder block. The screw fasteners 40 are threaded into threaded openings 84 in the block mounting surface 34 to secure the valley cover to the cylinder block.

In operation of the assembled engine shown in FIG. 1, the valley cover 36 acts as a structural stiffening member, strengthening the inside valley defining walls 30 of the cylinder block and stiffening the block against bending and vibration. In addition, the enclosed valley 32 provides a path for pulsing air flow passing between the front 64 and rear 70 crank chambers through the openings 72 in the valley floor. The cyclic flow occurs because the crankpins in the first and fourth crank chambers are located 180 degrees apart so that the pairs of pistons connected with those crankpins move in opposite directions. This causes air to be forced out of the first crank chamber and into the fourth crank chamber when the front pair of pistons are moving downward and causing reverse flow in the opposite half of the cycle when the rear pair of the pistons are moving downward. This feature has provided a substantial reduction in oil entrainment in the air flowing between the first and fourth chambers since the majority, or at least a major portion, of the air flow is through the valley in which little oil is present.

Perhaps surprisingly, it has been found advantageous not to provide openings from the second and third crank chambers 66, 68 into the valley 32. The piston connected crankpins in these chambers are also positioned 180 degrees apart so there is a substantial pulsing air flow oscillating between these chambers also. However these crankpins are 90 degrees away from the crankpins of end chambers 64, 70 so it appears that there is an advantage in directing the air flow between chambers 66, 68 through another flow path than the air flow between chambers 64, 70. Thus air flow between the inner chambers 66, 68 must pass through the opening 74 in the center bulkhead or through the crankcase beside or below the associated main bearing cap 16. Since this flow passes only between adjacent crank chambers, the distance and the rate of the flow are less than for flow between the first and fourth chambers so that the oil pickup by this flow is apparently substantially lower. Thus the arrangement described apparently avoids interference between the differently phased pulsing flows of the first and fourth crank chambers 64, 70 and the second and third crank chambers 66, 68 and thereby provides a substantial reduction in oil entrainment, allowing a greater proportion of the engine oil to remain in the laterally extended sump oil pan 14.

While the invention has been described by reference to a particular embodiment, it should be understood that numerous changes may be made within the spirit and scope of the inventive concepts described. Accordingly, it is intended that the invention not be limited to the described embodiment, but that it have the full scope defined by the language of the following claims.

I claim:

1. An engine cylinder block assembly comprising an integral cylinder block and a separate valley cover acting as a stiffening and closing member;

said cylinder block including crankcase defining walls connecting with a pair of outwardly angled cylinder banks, inside walls defining an upwardly open valley between the cylinder banks, and front and rear end walls interconnecting the cylinder banks and the inside walls and closing ends of the valley, wherein upper ends of the inside and end walls form a mounting surface;

said valley cover comprising an integral stiffening plate having a peripheral lower surface secured to the mounting surface of the block and closing the open valley against the entry of fluids from above, said cover acting to structurally stiffen the block structure by tying together the block inside walls at locations intermediate the front and rear end walls;

the valley cover being relatively thicker above said peripheral lower surface and at spaced locations intermediate longitudinal ends to provide the desired structural stiffness, portions of the cover intermediate the ends and said spaced locations being made thinner to minimize unnecessary mass.

2. An engine cylinder block assembly as in claim 1 including seal means between said valley cover peripheral lower surface and said block mounting surface for sealing the interface against fluid leakage, the seal means being of a type which maintains a solid structural connection between the valley cover and the block inside walls.

3. An engine cylinder block assembly as in claim 1 wherein said cylinder block and said valley cover are made of an aluminum based material.

4. An engine cylinder block assembly as in claim 1 wherein said block mounting surface and the peripheral lower surface of the valley cover are planar.

5. An engine cylinder block assembly comprising an integral cylinder block and a separate valley cover acting as a stiffening and closing member:

said cylinder block including crankcase defining walls connecting with a pair of outwardly angled cylinder banks, inside walls defining an upwardly open valley between the cylinder banks, and front and rear end walls interconnecting the cylinder banks and the inside walls and closing ends of the valley, wherein upper ends of the inside and end walls form a mounting surface;

said valley cover comprising an integral stiffening plate having a peripheral lower surface secured to the mounting surface of the block and closing the open valley against the entry of fluids from above, said cover acting to structurally stiffen the block structure by tying together the block inside walls at locations intermediate the front and rear end walls;

said cylinder block including spaced bosses extending upward from a floor of the valley and each defining a pad for mounting a knock sensor for sensing combustion knock in the cylinders during engine operation, said valley cover including downwardly extending pockets for receiving the knock sensors, and seals at lower ends of the pockets for engaging the bosses to limit fluid flow from the valley to the interiors of the pockets, said pockets being upwardly open to permit removal of the knock sensors from their respective mounting pads without requiring removal of the valley cover from the cylinder block.

6. An engine cylinder block assembly comprising an integral cylinder block and a separate valley cover acting as a stiffening and closing member:

said cylinder block including crankcase defining walls connecting with a pair of outwardly angled cylinder banks, inside walls defining an upwardly open valley between the cylinder banks, and front and rear end walls interconnecting the cylinder banks and the inside walls and closing ends of the valley, wherein upper ends of the inside and end walls form a mounting surface;

said valley cover comprising an integral stiffening plate having a peripheral lower surface secured to the mounting surface of the block and closing the open valley against the entry of fluids from above, said cover acting to structurally stiffen the block structure by tying together the block inside walls at locations intermediate the front and rear end walls;

said cylinder block including three transverse bulkheads intermediate the front and rear end walls and separating the crankcase interior into longitudinally aligned first, second, third and fourth crank chambers, each open to a transversely opposite pair of cylinders adapted for receiving, in engine assembly, pistons connected to a common crankpin, wherein the crankpins of the front and rear, first and fourth, crank chambers are phased 180 degrees apart and the crankpins of the longitudinally adjacent second and third crank chambers are phased 180 degrees apart;

said cylinder block inside walls including air flow openings connecting the valley with the first and fourth crank chambers but omitting openings between the valley and the second and third crank chambers, whereby air transfer between the second and third crank chambers is directed primarily through the crankcase while a substantial portion of air transfer between the first and fourth crank chambers is directed through the valley.

7. An engine cylinder block assembly as in claim 6 wherein said cylinder block includes openings in the bulkheads to facilitate air transfer between the crank chambers.

8. An engine cylinder block assembly as in claim 7 wherein said cylinder block includes openings in the front and rear walls to connect, in an engine assembly, the crankcase and the valley volumes with cover enclosed volumes outside the front and rear walls to maximize the interconnected volumes of the crankcase and valley and thereby reduce pressure variations therein.

9. An engine valley cover for closing against fluid entry from above the upper portion of a valley defined between cylinder banks of a V-type engine while providing added stiffness to an associated cylinder block, said cover comprising:

a cast body having a rigid periphery including longitudinally spaced end portions and laterally spaced side portions defining a planar lower peripheral mounting surface;

rigid load carrying transverse portions spaced longitudinally intermediate said end portions for rigidly interconnecting said side portions; and panel-like portions of reduced thickness between said periphery and said load carrying transverse portions configured to minimize mass of the cover while maintaining closure of the valley and adequate stiffness to provide the desired stiffening of the associated cylinder block.

10. An engine valley cover as in claim 9 including:

cylindrical component receiving pockets extending downward from internal portions of said body, said pockets including generally tubular walls integral with said body, said pockets being open at lower ends thereof; and seal means fixed to said lower ends of the pockets to engage in assembly an associated member and limit fluid flow into the pockets from below.

11. An engine valley cover as in claim 9 including fastener openings spaced around said rigid periphery for receiving fastener means for rigidly securing the valley cover to an associated block.

* * * * *